US010036588B2

(12) United States Patent
Favila et al.

(10) Patent No.: US 10,036,588 B2
(45) Date of Patent: Jul. 31, 2018

(54) DOOR ALARM SYSTEM AND REFRIGERATION DEVICE

(71) Applicant: Sears Brands, L.L.C., Hoffman Estates, IL (US)

(72) Inventors: Angel Favila, Lake in the Hills, IL (US); Puneet Shivam, Schaumburg, IL (US)

(73) Assignee: SEARS BRANDS, L.L.C., Hoffman Estates, IL (US)

( * ) Notice: Subject to any disclaimer, the term of this patent is extended or adjusted under 35 U.S.C. 154(b) by 105 days.

(21) Appl. No.: 15/147,588

(22) Filed: May 5, 2016

(65) Prior Publication Data

US 2017/0321960 A1 Nov. 9, 2017

(51) Int. Cl.

| | |
|---|---|
| ***F25D 29/00*** | (2006.01) |
| ***F25D 11/02*** | (2006.01) |
| ***F25D 23/02*** | (2006.01) |

(52) U.S. Cl.

CPC ..... *F25D 29/008* (2013.01); *F25D 11/02* (2013.01); *F25D 23/028* (2013.01); *F25D 29/005* (2013.01); *F25D 2323/024* (2013.01); *F25D 2700/02* (2013.01)

(58) Field of Classification Search

CPC ..... F25D 2900/05; F25D 2900/008; F25D 2700/02; F25D 29/005; F25D 29/008; F25D 23/028

USPC ..... 62/131

See application file for complete search history.

(56) References Cited

U.S. PATENT DOCUMENTS

| | | | | |
|---|---|---|---|---|
| 4,528,558 | A | 7/1985 | Steers et al. | |
| 4,566,285 | A | 1/1986 | Tershak et al. | |
| 5,451,930 | A | 9/1995 | McDaniel | |
| 5,479,152 | A | 12/1995 | Walker et al. | |
| 2005/0178131 | A1* | 8/2005 | Ryu | F25D 11/02 62/131 |
| 2014/0313328 | A1* | 10/2014 | Park | H04N 7/183 348/143 |

OTHER PUBLICATIONS

"Precision Hall Effect Angle Sensor IC with I2C Interface", Allegro MicroSystems, LLC, A1332, dated Dec. 1, 2015, 20 pages.
"14-bit Resolution", www.ams.com/AS5048, dated Nov. 2012, 2 pages.
"14-bit Rotary Position Sensor with Digital Interface", AS5048A, ww.ams.com, dated Jun. 26, 2013, 8 pages.
"optoNCDT//Laser Triangulation Displacement Sensors", Micro-Epsilon, dated Apr. 2016, 8 pages.
"Digital IR Line Sensor—QRE1113", www.robotshop.com/en/sfe-digital-ir-line-sensor-qre1113.html, dated Apr. 27, 2016, 3 pages.
"Industry Standard Laser Sensor", www.micro-epsilon.com/displacement-position-sensors/laser-sensor/optoNCDT_1700_basic/index.html, dated Apr. 27, 2016, 2 pages.
"QRE1113, QRE1113GR Minature Reflective Object Sensor", Fairchild Semiconductor Corporation, dated Sep. 2009, 8 pages.

* cited by examiner

*Primary Examiner* — Marc Norman
(74) *Attorney, Agent, or Firm* — McAndrews, Held & Maloy, Ltd.

(57) ABSTRACT

Door alarm systems, methods, and apparatus are disclosed. A door alarm system may monitor a door of a refrigeration device and detect a failed attempt at closing the door. In response to detecting the failed attempt, the door alarm system may generate a notification of the detected, failed attempt so that remedial action may be taken.

20 Claims, 6 Drawing Sheets

DOOR ALARM SYSTEM AND REFRIGERATION DEVICE

FIELD OF THE DISCLOSURE

The present disclosure generally relates to refrigerators, freezers, and other refrigeration devices and more specifically to door alarm systems for refrigeration devices.

BACKGROUND

Refrigerators typically sound an audible alarm when a door to either the freezer compartment or fresh food compartment remains open for a predetermined period of time. By sounding an alarm, a person may be prompted to close the door. In this manner, the refrigerator may avoid spoilage resulting from increased internal temperature of the freezer and fresh food compartments.

Door alarms may be helpful when a door to either compartment is inadvertently left open since sounding an alarm may bring attention to the undesirable and unintended condition of the refrigerator. However, as noted above, refrigerators sound an alarm after a predetermined period of time has past. By the time the refrigerator sounds the alarm, the person who opened the door may no longer be in the immediate vicinity. As such, the alarm may go unheard, and appropriate remedial action may not occur. Situations in which the alarm goes unanswered are more likely when the door fails to close due to an obstruction. In such situations, the person who opened the door is more likely to walk away from the refrigerator unaware that the door did not close properly.

BRIEF SUMMARY OF THE DISCLOSURE

Shown in and/or described in connection with at least one of the figures, and set forth more completely in the claims are systems and methods that detect failed attempts at closing a door of a refrigerator, freezer, or other refrigeration device and activate an alarm in response to detecting such an unsuccessful attempt.

These and other advantages, aspects and novel features of the present disclosure, as well as details of illustrated embodiments thereof, will be more fully understood from the following description and drawings.

DETAILED DESCRIPTION

In some embodiments, a door alarm system may monitor a door and detect a failed attempt at closing the door. In response to detecting the failed attempt, the door alarm system may generate a notification of the detected, failed attempt so that remedial action may be taken. In some embodiments, the door alarm system may monitor a door of a refrigeration device such as a door to a freezer compartment or fresh food compartment of a refrigerator.

Figure 2:
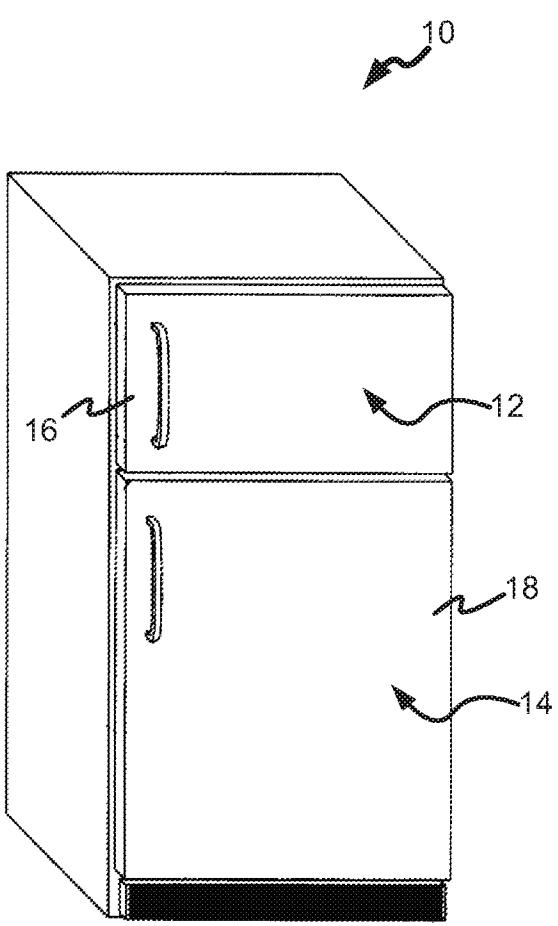
FIG. 2 shows a refrigerator having a top-freezer arrangement of refrigeration compartments in accordance with an example embodiment.
Figure 1:
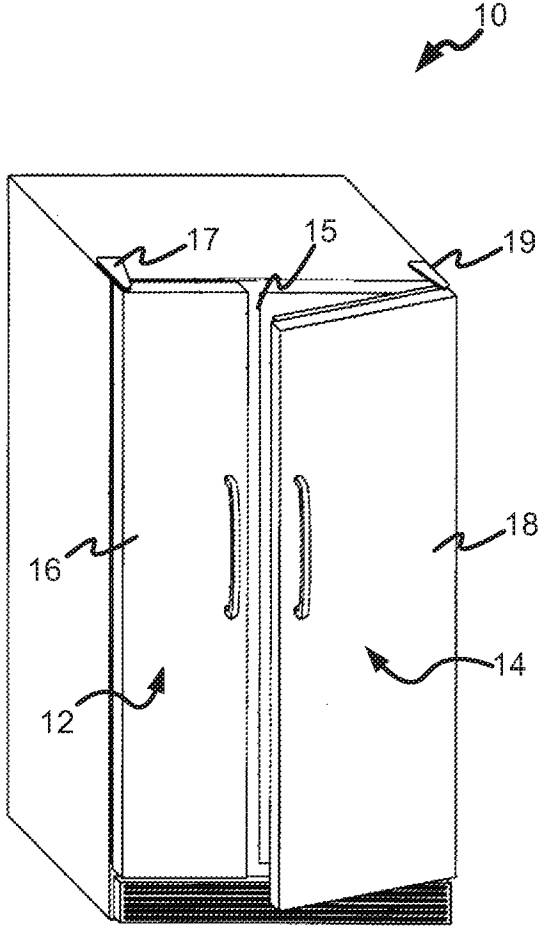
FIG. 1 shows a refrigerator having a side-by-side arrangement of refrigeration compartments in accordance with an example embodiment.

FIG. 1 and FIG. 2 show two arrangements for a refrigerator or a refrigeration device 10 having a door alarm system. In particular, FIG. 1 depicts the refrigeration device 10 in a side-by-side arrangement in which vertical freezer and fresh foods compartments 12, 14 and respective doors 16, 18 are positioned side-by-side. FIG. 2 depicts the refrigeration device 10 in a top-freezer arrangement in which the freezer compartment 12 and respective freezer door 16 are positioned above the fresh foods compartment 14 and its respective fresh food door 18. The two arrangements shown in FIGS. 1 and 2 are for illustrative purposes. Other arrangements may incorporate aspects of the present door alarm system. For example, the refrigeration device 10 may include one, two, three, or more refrigerated compartments. Moreover, each refrigerated compartment may include one or more doors for accessing the respective compartment.

Referring to FIGS. 1 and 2, the refrigeration device 10 may include an insulated partition 15 between the freezer and the fresh food compartments 12, 14. The refrigeration device 10 may further include a freezer door 16 and a fresh food door 18. The freezer door 16 may be hung on one or more hinges 17 which permit the freezer door 16 to swing between an opened state and a closed state. Similarly, the fresh food door 18 may be hung on one or more hinges 19 which permit the fresh food door 18 to swing between an opened state and a close state. When closed, the freezer door 16 and fresh food door 18 may respectively seal off the freezer compartment 12 and the fresh food compartment 14 from the outside. Conversely, when opened, the freezer door 16 and fresh food door 18 may grant access to the items stored in the freezer compartment 12 and the fresh food compartment 14.

Figure 3:
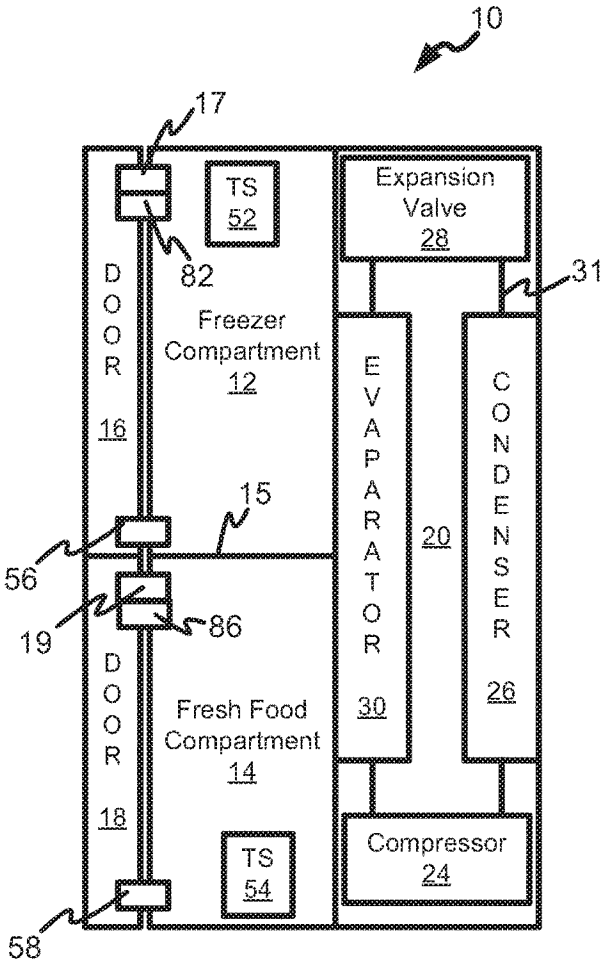
FIG. 3 provides a block diagram that depicts further details of the refrigerators shown in FIGS. 1 and 2.
Figure 3:
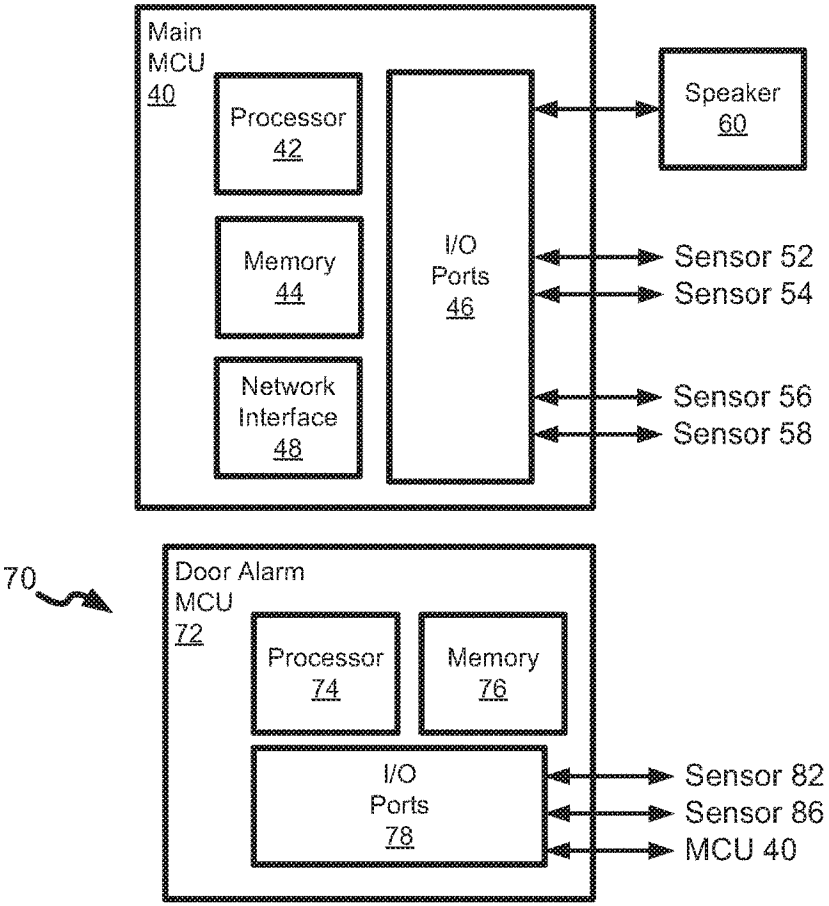

Further details of the refrigeration device 10 are shown in FIG. 3. As shown, the refrigeration device 10 may further include a refrigeration system 22 configured to cool the refrigerated compartments 12, 14. The refrigeration system 22 may include a compressor 24, a condenser 26, an expansion valve 28, and an evaporator 30, coupled to each other via tubing 31. The compressor 24 may compress refrigerant flowing through the refrigeration system 22. In particular, the refrigerant may flow from the compressor 24 through the condenser 26, the expansion value 28, and the evaporator 30 before returning to the compressor 24. The evaporator 30 may refrigerate air via heat transfer and the refrigerated air may be used to cool the compartments 12, 14. In one embodiment, the refrigeration system 22 may be configured to maintain the freezer compartment 12 at temperatures substantially below freezing (32° F.). The refrigeration system 22 may be further configured to maintain the fresh food compartment 14 at temperatures below ambient temperature but above freezing (32° F.). In this manner, the freezer compartment 12 may freeze or maintain frozen items and the fresh food compartment 14 may cool items without freezing such item.

As show, the refrigeration device 10 may further include a main microcontrol unit (MCU) 40. The main MCU 40 may be configured to control operation of various aspects of the refrigeration device 10. To this end, the main MCU 40 may include a processor 42, a memory 44, one or more I/O ports 46, and a network interface 48. In some embodiment, the processor 42, the memory 44, the I/O ports 46, and the network interface 48 may be implemented with separate, discrete components. In other embodiments, the processor 42, the memory 44, the I/O ports 46, and the network interface 48 may be provided by a single-chip microcontroller, which are available from various vendors.

The processor 42 may be configured to execute instructions, manipulate data and generally control operation of other components of the refrigeration device 10 as a result of its execution. The memory 44 may include various types of random access memory (RAM) devices, read only memory (ROM) devices, flash memory devices, and/or other types of volatile or non-volatile memory devices. In particular, such memory devices of the memory 44 may store instructions and/or data to be executed and/or otherwise accessed by the processor 42.

The I/O ports 46 may generally provide the main MCU 40 with the ability to send and receive data signals. In particular, one or more I/O ports 46 may be coupled to other components of the refrigeration device 10 to permit the exchange of data and other communications between the main MCU unit 40 and the other components. Moreover, one or more I/O ports 46 may be coupled to various sensors used to monitor aspects of the refrigeration device 10.

The network interface 48 may enable communication with external computing devices such as laptop computing devices, tablet computing device, smart phones, etc. via a network. To this end, the network interface 48 may include a wired network interface such as an Ethernet (IEEE 802.3) interface, a wireless network interface such as a WiFi (IEEE 802.11) interface, a radio or mobile interface such as a cellular interface (GSM, CDMA, LTE, etc.), and/or some other type of network interface capable of providing a communications link between the main MCU 40 and another computing device. In some other embodiments, the main MCU 40 may be implemented without the network interface 48. In such embodiments, the refrigeration device 10 may simply operate without networking capabilities.

The main MCU 40 may be configured to control operation of the refrigeration system 22. To this end, the refrigeration device 10 may further include temperature sensor 52, 54 coupled to I/O ports 46 of the main MCU 40. The temperature sensors 52, 54 may be respectively positioned in the freezer compartment 12 and the fresh food compartment 14. Based on signals received from temperature sensor 52, 54, the main MCU 40 may determine the internal temperature of the refrigerated compartments 12, 14 and may adjust the operation of the refrigeration system 22 to maintain the refrigerated compartments 12, 14 at desired temperature levels.

The main MCU 40 may be further configured to detect whether the doors 16, 18 are open or closed. To this end, the refrigeration device 10 may further include open door sensors 56, 58 that are coupled to I/O ports 46 of the main MCU 40. The open door sensors 56, 58 may provide the main MCU 40 with signals indicative of an open state or a closed state for an associated door 16, 18. In particular, the open door sensor 56 may be mounted such that a spring-loaded actuator of the open door sensor 56 is compressed by the freezer door 16 when the door 16 is closed. Similarly, the open door sensor 58 may be mounted such that a spring-loaded actuator of the open door sensor 58 is compressed by the fresh food door 18 when the door 18 is closed. When either door 16, 18 is opened, the actuator of the respective open door sensor 56, 58 may move outwardly, thereby causing the respective open door sensor 56, 58 to provide the main MCU 40 with a signal that indicates that the associated door 16, 18 is open. When either door 16, 18 is closed, the actuator of the respective sensor 56, 58 may move inwardly, thereby causing the respective open door sensor 56, 58 to provide the main MCU 40 with a signal that indicates that the associated door 16, 18 is closed.

The main MCU 40 may further generate notifications regarding detected status of the refrigeration device 10. To this end, a speaker 60 may be coupled to an I/O port 46 of the main MCU 40. The main MCU 40 may generate a door alarm notification by driving the speaker 60 to sound an audible alarm. The main MCU 40 may generate such a door alarm notification in response to either the freezer door 16 or the fresh food door 18 remaining open for more than a predetermined period of time. Furthermore, the main MCU 40 may also generate a door alarm notification by driving the speaker 60 to sound an audible alarm in response to detecting a failed attempt at closing either door 16, 18.

In some embodiments, the main MCU 40 may generate the door alarm notification immediately after detecting the failed attempt at closing either door 16, 18. In some embodiments, the main MCU 40 may generate the notification within 1 second, within 5 seconds, or within 10 seconds of detecting the failed attempt at closing either door 16, 18. Generating the notification so shortly after detecting the failed attempt may ensure that the person closing the door is still in the vicinity of the refrigeration device 10 when the notification is sent so that remedial action may be taken.

Besides sounding alarms, the main MCU 40 may also generate notifications and send such notifications via the network interface 48. For example, instead of, or in addition to, sounding an alarm via the speaker 60, the main MCU 40 may generate and send an email message, a short message service (SMS) message, an instant message, a push notification, or some other electronic message via the network interface 48 in order to notify a user of a detected status such as a detected open door, a detected failed attempt at closing a door, or some other detected status.

As shown in FIG. 3, a door alarm system 70 of the refrigeration device 10 may include a door alarm microcontrol unit (MCU) 72. As explained in greater detail below with respect to FIGS. 6 and 7, the door alarm MCU 72 may monitor the status of the freezer door 16 and the fresh food door 18 and generate a notification in response to a detected failed attempt at closing either door 16, 18. To this end, the door alarm MCU 72 may include a processor 74, a memory 76, and one or more I/O ports 78. In some embodiment, the processor 74, the memory 76, and the I/O ports 78 may be implemented with separate, discrete components. In other embodiments, the processor 74, the memory 76, and the I/O ports 78 may be provided by a single-chip microcontroller, which are available from various vendors. While door alarm MCU 72 is depicted as a separate unit, in some embodiments, the refrigeration device 10 may include a single MCU that provides the functionality of both the main MCU 40 and the door alarm MCU 72.

The processor 74 may be configured to execute instructions, manipulate data and generally control operation of other components of the door alarm system 70 as a result of its execution. The memory 76 may include various types of random access memory (RAM) devices, read only memory (ROM) devices, flash memory devices, and/or other types of volatile or non-volatile memory devices. In particular, such memory devices of the memory 76 may store instructions and/or data to be executed and/or otherwise accessed by the processor 74.

Finally, the I/O ports 76 may generally provide the door alarm MCU 72 with the ability to send and receive data signals. In particular, one or more I/O ports 76 may be coupled to the main MCU 40 of the refrigeration device 10 to permit the exchange of data and other communications between the main MCU unit 40 and the door alarm MCU 72. Moreover, one or more I/O ports 76 may be coupled to door sensors 82, 86 used to monitor the freezer door 16 and the fresh food door 18.

Figure 4:
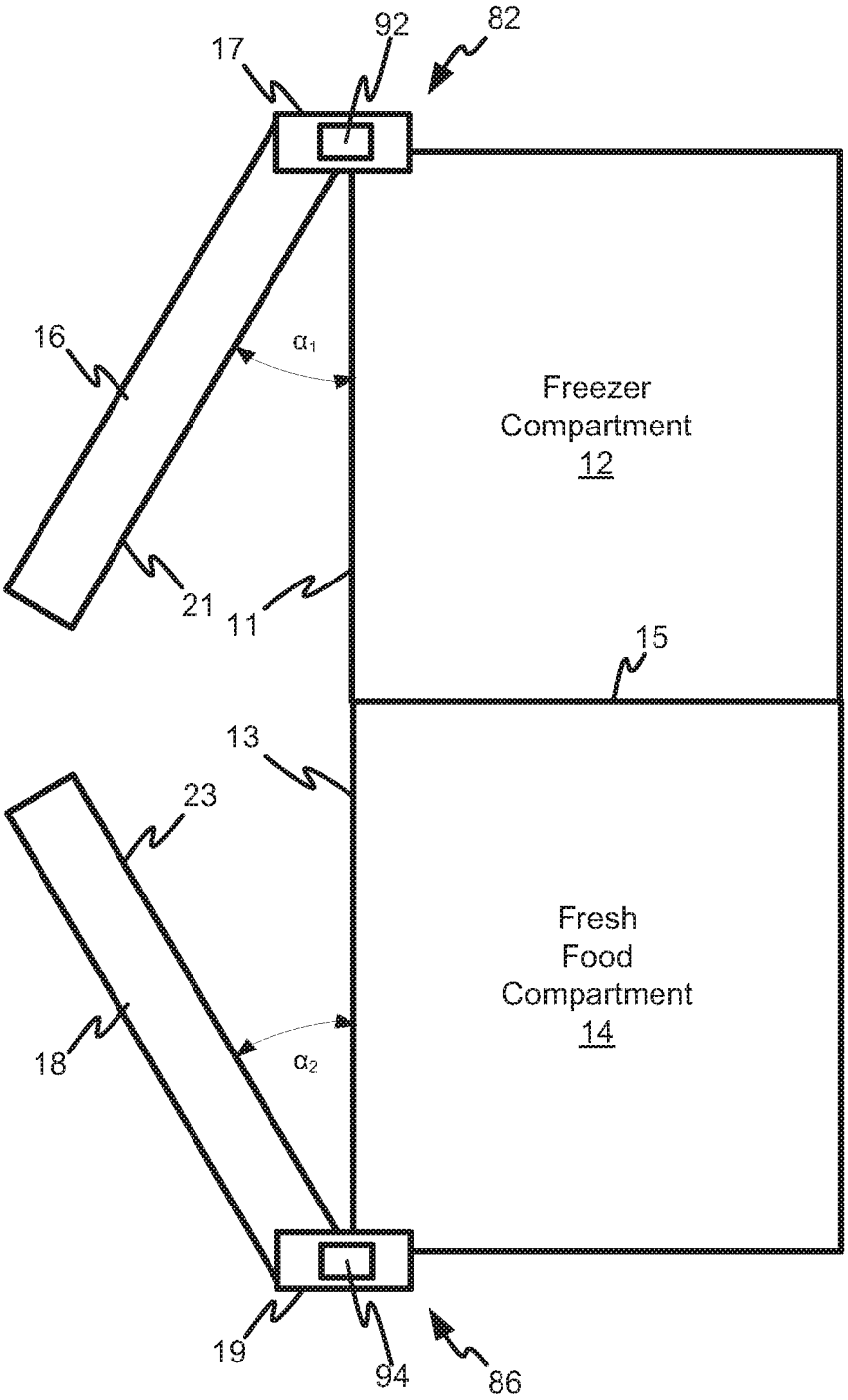
FIG. 4 depicts angle sensors of the refrigerators shown in FIGS. 1 and 2.

The freezer door sensor 82 may be positioned to monitor the freezer door 16 and provide the door alarm MCU 72 with a status signal indicative of a position of the freezer door 16. Similarly, the fresh food door sensor 86 may be positioned to monitor the fresh food door 18 and provide the door alarm MCU 72 with a status signal indicative of a position of the fresh food door 18. In one embodiment, each sensor 82, 86 includes an angle sensor which detects an angle of the respective door 16, 18 with respect to a stationary part of the refrigeration device 10 and generates a status signal indicative of the detected angle. More specifically, as shown in FIG. 4, an angle sensor 92 of the freezer door sensor 82 may be positioned in or near the one or more freezer door hinges 17. Likewise, an angle sensor 94 of the fresh food door sensor 82 may be positioned in or near the one or more fresh food door hinges 19. Each of the angle sensors 92, 94 may be positioned such that the angle sensor 92, 94 generates a signal that is indicative of a relative angle $\alpha_1$, $\alpha_2$ between a front surface 11, 13 of the respective refrigerated compartment 12, 14 and a surface 21, 23 of the respective door 16, 18 facing the compartment 12, 14. In some embodiments, the angle sensors 92, 94 may measure the relative angle $\alpha_1$, $\alpha_2$ and generate a 14-bit digital output that provides an accuracy of 0.022 degrees with a latency of less than 50 milliseconds.

In some embodiments, each angle sensor 92, 94 may be implemented with an AS5048A sensor, which is available from ams Sensor Solutions Germany GmbH. The AS5048A sensor is a 14-bit magnetic rotary position sensor with digital interface. The AS5048A sensor may be attached to the hinges 17, 19, and may generate a digital reading indicative of the relative angle $\alpha_1$, $\alpha_2$. The AS5048A sensor may be further coupled to an I/O port 78 of the door alarm MCU 72 via a serial peripheral interface (SPI) so that the door alarm MCU 72 may obtain a reading of the relative angle $\alpha_1$, $\alpha_2$ from the angle sensor 92, 94. While each angle sensor 92, 94 may be implemented with an AS5048A sensor, other embodiments may use other angle sensors that are capable of monitoring the relative angle $\alpha_1$, $\alpha_2$ and providing a reading of such angle $\alpha_1$, $\alpha_2$.

Figure 5:
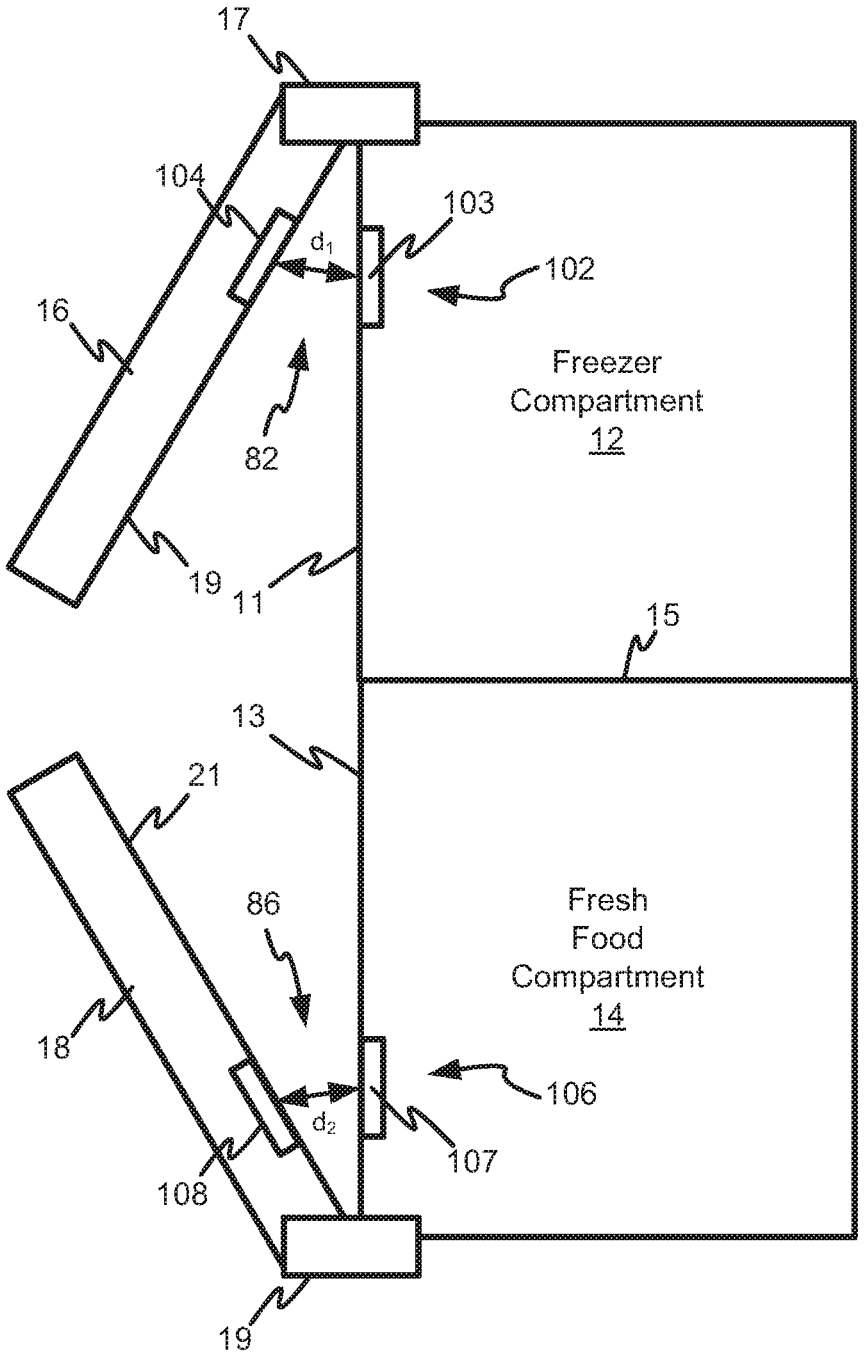
FIG. 5 depicts distance sensors of the refrigerators shown in FIGS. 1 and 2.

In another embodiment, each sensor 82, 86 may include a linear distance sensor which detects a distance between the refrigerated compartment 12, 14 and the respective door 16, 18. More specifically, as shown in FIG. 5, a distance sensor 102 of the freezer door sensor 82 may be positioned on the front surface 11 of the freezer compartment 12 and/or on a facing surface 21 of the freezer door 16. Likewise, a second distance sensor 106 of the fresh food door sensor 86 may be positioned on the front surface 13 of the fresh food compartment 14 and/or on a facing surface 23 of the fresh food door 18. Each of the distance sensors 102, 106 may provide the door alarm MCU 72 with a signal that is indicative of distance between its respective refrigerated compartment 12, 14 and its associated door 16, 18. Furthermore, each of distance sensors 102, 106 may provide a limited detection range such as 0-200 millimeters with micrometer accuracy. In this manner, the distance sensors 102, 106 may provide distance measurements $d_1$, $d_2$ when the respective door 16, 18 is nearly closed.

In general, the distance sensors 102, 106 may each include an emitter and a detector. For example, the distance sensor 102 may include an infrared (IR) emitter 103 positioned on the front surface 11 of the freezer compartment 12 and an IR detector 104 positioned on the facing surface 21 of the freezer door 16. The IR emitter 103 may emit infrared energy with a beam angle of 20° and a wavelength of 850-950 nanometers (nm). The IR detector 104 may receive the emitted infrared energy and provide the distance sensor 102 with a signal indicative of the received energy. Based upon such signal received from the IR detector 104, the distance sensor 102 may generate a measurement of the distance $d_1$ between the front surface 11 of the freezer compartment 12 and the facing surface 21 of the freezer door 16. While FIG. 5 depicts the IR emitter 103 on the front surface 11 of the compartment 12 and the IR detector 104 on the facing surface 21 of the freezer door 16, alternatively the IR emitter 103 may be placed on the facing surface 21 of the freeze door 16 and the IR detector 104 may be placed on the front surface 11 of the compartment 12.

The distance sensor 106 may be implemented in a similar manner with an IR emitter 107 on the front surface 13 of the compartment 14 and an IR detector 108 on the facing surface 23 of the fresh food door 18; or with the IR detector 108 on the front surface 13 of the compartment 14 and the IR emitter 107 on the facing surface 23 of the fresh food door 18. In this manner, the distance sensor 106 may generate a measurement of the distance $d_2$ between the front surface 13 of the fresh food compartment 14 and the facing surface 23 of the fresh food door 18. Furthermore, while distance sensors 102, 106 have been described as IR sensors, distance sensors 102, 106 may be implemented using other forms of radiation such as acoustical, laser, or radio radiation.

Figure 6:
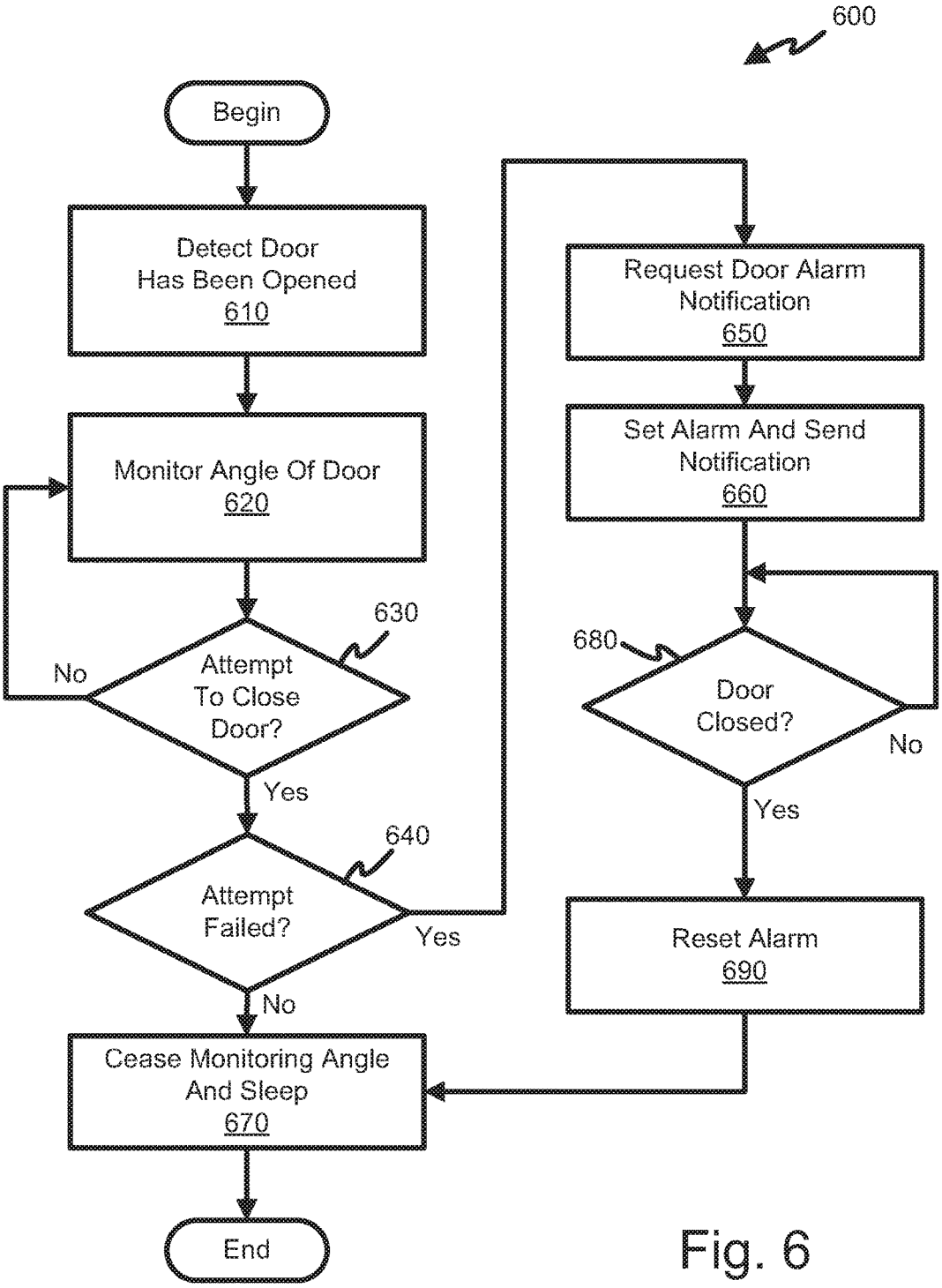
FIG. 6 shows a flowchart of a door alarm method utilizing an angle sensor of the refrigerators shown in FIGS. 1 and 2.

Referring now to FIG. 6, a door alarm method 600 is shown. For clarity purposes, the door alarm method 600 is described below with respect to monitoring the fresh food door 18 and generating a notification based on the detected angle $\alpha_2$ of the door 18. While described with respect to the fresh food door 18, the door alarm method 600 is also applicable to monitoring the freezer door 16.

At 610, the main MCU 40 may detect the fresh food door 18 has been opened. The MCU 40, in response to detecting that the fresh food door 18 has been open, may inform the door alarm MCU 72 of the detected state of the fresh food door 18. In particular, in response to the fresh food door 18 being opened, the actuator of the open door sensor 58 for the fresh food door 18 may move outwardly. Due to the outward movement of the actuator, the open door sensor 58 may provide the main MCU 40 with a signal indicating that the fresh food door 18 has been opened. The main MCU 40 may in turn provide the door alarm MCU 72 with a signal indicating that the fresh food door 18 has been opened.

In response to receiving the signal from the main MCU 40, the door alarm MCU 72 at 620 may begin to monitor the relative angle $\alpha_2$ of the fresh food door 18 via the angle sensor 94 to detect an attempt at closing door 18. At 630, the door alarm MCU 72 may detect, based on the detected angle $\alpha_2$, that the door 18 is moving from an open state toward a closed state and that an attempt to close the door 18 has commenced. In particular, the door alarm MCU 72 may determine that a person is attempting to close the door 18 in response to detecting that the detected angle $\alpha_2$ has decreased below a predetermined threshold angle $\alpha_{T2}$. In this manner, the door alarm MCU 72 does not determine that a person is attempting to close the fresh food door 18 when the door 18 is in the process of being opened. In particular, during the process of opening the fresh food door 18, the detected angle $\alpha_2$ is increasing. As such, even though the detected angle $\alpha_2$ may be less than the predetermined threshold angle $\alpha_{T2}$, the door alarm MCU 72 may determine that the door 18 is opening and not closing and thus does not inaccurately determine that someone is attempting to close the door 18.

In some embodiments, the predetermined threshold angle $\alpha_{T2}$ is 20°. However, other embodiments may utilize other threshold angles that are good indications that a person intended to close the door 18. For example, some embodiments may define the predetermined threshold angle $\alpha_{T2}$ any angle less than 25°, any angle less than 20°, any angle between 25° and 5°, or any angle between 20° and 10°.

If the door alarm MCU 72 at 630 does not detect an intent or attempt to close the door 18, then the door alarm MCU 72 may return to 620 and continue to monitor the angle $\alpha_2$ of the door 18 for an intent to close the door 18. Otherwise, the door alarm MCU 72 may proceed to 640 to attempt to detect a failed attempt at closing the door 18. At 640, the door alarm MCU 72 may determine whether the attempt at closing the door 18 failed. For example, if the rate of change for the detected angle $\alpha_2$ decreased by more than a threshold level $T_{Astop}$ and the door 18 is not closed, then the door alarm MCU 72 may determine that the attempt at closing the door 18 failed due to the door 18 likely hitting an obstruction. Furthermore, if the door alarm MCU 72 determines via the rate of change for the detected angle $\alpha_2$ that the door 18 slowly came to a stop and the door 18 is not closed, then again the door alarm MCU 72 may determine that the attempt at closing the door 18 failed.

In response to determining that the attempt at closing the door 18 failed, the door alarm MCU 72 at 650 may request the main MCU 40 to generate a door alarm notification. In response to such request, the main MCU 40 at 660 may generate a door alarm notification that informs a user that the door 18 failed to close. For example, the main MCU 40 may sound an alarm via speaker 60, send a notification message via network interface 48, or both.

If the door alarm MCU 72 at 640 determines the door 18 is closed, then the door alarm MCU 72 may determine that the door 18 was successfully closed. As such, the door alarm MCU 72 may proceed to 670. At 670, the door alarm MCU 72 may cease monitoring the angle $\alpha_2$ of the door 18 and may enter a sleep state to conserve energy. In some embodiments, the door alarm MCU 72 may determine that the door 18 is closed in response to the detected angle $\alpha_2$ having a predetermined relationship (e.g., less than or equal to) a predetermined value such as 0°. In some embodiments, the door alarm MCU 72 may determine that the door 18 is closed in response to receiving signals from the main MCU 40 that indicate that the door 18 is closed. For example, the main MCU 40 may send such a signal in response to the actuator of the open door sensor 58 being compressed by the door 18.

After generating the door alarm notification, the main MCU 40, the door alarm MCU 72, or both may continue to monitor the door 18 at 680 to determine when the door 18 is closed. In response to detecting that the door 18 is closed, the main MCU 40, the door alarm MCU 72, or both may reset the alarm at 690. For example, the main MCU 40 may detect that the door 18 has closed via the open door sensor 58 for the door 18 and instruct the door alarm MCU 72 to proceed to 670 in order to cease monitoring the angle of the door 18 and enter a sleep state. In other embodiments, the door alarm MCU 72 may determine that the door 18 is closed in response to the detected angle $\alpha_2$ having a predetermined relationship (e.g., less than or equal to) a predetermined value such as 0°.

Figure 7:
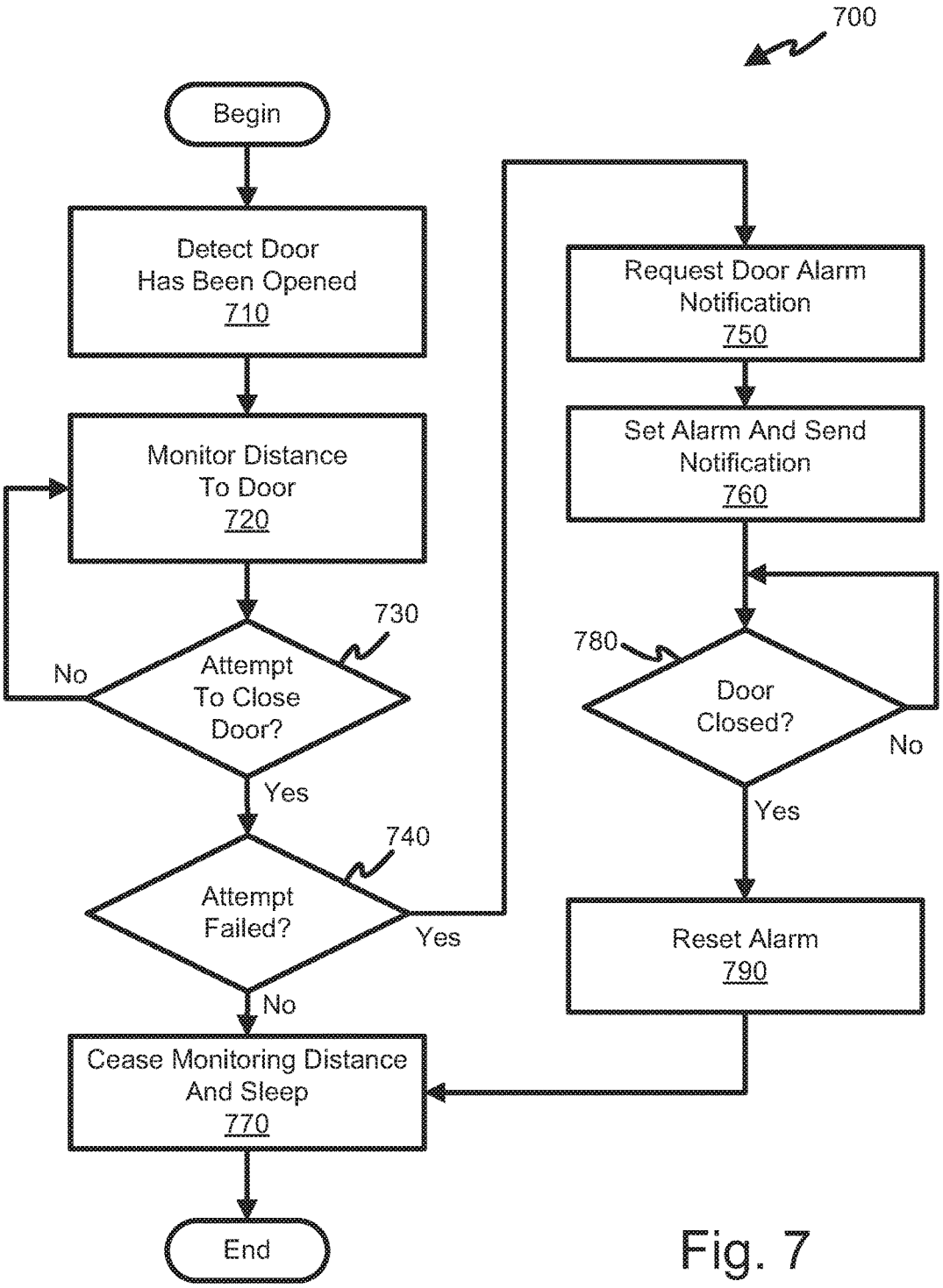
FIG. 7 shows a flowchart of a door alarm method utilizing a distance sensor of the refrigerators shown in FIGS. 1 and 2.

Referring now to FIG. 7, another door alarm method 700 is shown. For clarity purposes, the door alarm method 700 is described below with respect to monitoring the fresh food door 18 and generating a notification based on the detected distance $d_2$ between the front surface 13 of the compartment 14 and a facing surface 23 of the door 18. While described with respect to the fresh food door 18, the door alarm method 700 is also applicable to monitoring the freezer door 16.

At 710, the main MCU 40 may detect the fresh food door 18 has been opened. The MCU 40, in response to detecting that the fresh food door 18 has been open, may inform the door alarm MCU 72 of the detected state of the fresh food door 18. In particular, in response to the fresh food door 18 being opened, the actuator of the open door sensor 58 for the fresh food door 18 may move outwardly. Due to the outward movement of the actuator, the open door sensor 58 may provide the main MCU 40 with a signal indicating that the fresh food door 18 has been opened. The MCU 40 may in turn provide the door alarm MCU 72 with a signal indicating that the fresh food door 18 has been opened.

In response to received the signal from the main MCU 40, the door alarm MCU 72 at 720 may begin to monitor the distance $d_2$ between the front surface 13 of the compartment 14 and the facing surface of the fresh food door 18 via the distance sensor 106 to detect an attempt at closing door 18. At 730, the door alarm MCU 72 may detect, based on the detected distance $d_2$, that the door 18 is moving from an open state toward a closed state and that an attempt to close the door 18 has commenced. In particular, the door alarm MCU 72 may determine that a person is attempting to close the door 18 in response to detecting that the detected distance $d_2$ is decreasing. In this manner, the door alarm MCU 72 does not determine that a person is attempting to close the fresh food door 18 when the door 18 is in the process of being opened. Moreover, since the distance sensor 106, as note above, provides a limited range, e.g., 0-200 millimeters, the door alarm MCU 72 does not register or detect an attempt at closing the door 18 until the door 18 is nearly closed. In particular, after fully opening the door 18, if a person merely closes the door 18 a few inches, the door alarm MCU 72 will not falsely detect this slight change in the door's position as an attempt at closing the door 18 since the door 18 will remain out of range of its distance sensor 106.

If the door alarm MCU 72 at 730 does not detect an intent or attempt to close the door 18, then the door alarm MCU 72 may return to 720 and continue to monitor the distance $d_2$ of the door 18 for an intent to close the door 18. Otherwise, the door alarm MCU 72 may proceed to 740 to attempt to detect a failed attempt at closing the door 18. At 740, the door alarm MCU 72 may determine whether the attempt at closing the door 18 failed. For example, if the rate of change for the detected distance $d_2$ decreased by more than a threshold level $T_{Dstop}$ and the door 18 is not closed, then the door alarm MCU 72 may determine that the attempt at closing the door 18 failed due to the door 18 likely hitting an obstruction. Furthermore, if the door alarm MCU 72 determines via the rate of change for the detected distance $d_2$ that the door 18 slowly came to a stop and the door 18 is not closed, then again the door alarm MCU 72 may determine that the attempt at closing the door 18 failed.

In response to determining that the attempt at closing the door 18 failed, the door alarm MCU 72 at 750 may request the main MCU 40 to generate a door alarm notification. In response to such request, the main MCU 40 at 760 may generate a door alarm notification that informs a user that the door 18 failed to close. For example, the main MCU 40 may sound an alarm via speaker 60, send a notification message via network interface 48, or both.

If the door alarm MCU 72 at 740 determines the door 18 is closed, then the door alarm MCU 72 may determine that the door 18 was successfully closed. As such, the door alarm MCU 72 may proceed to 770. At 770, the door alarm MCU 72 may cease monitoring the distance $d_2$ of the door 18 and may enter a sleep state to conserve energy. In some embodiments, the door alarm MCU 72 may determine that the door 18 is closed in response to detecting that distance $d_2$ has a predetermined relationship (e.g., less than or equal to) a predetermined value such as 0 millimeters. In some embodiments, the door alarm MCU 72 may determine that the door 18 is closed in response to receiving signals from the main MCU 40 that indicate that the door 18 is closed. For example, the main MCU 40 may send such a signal in response to the actuator of the open door sensor 58 being compressed by the door 18.

After generating the notification, the main MCU 40, the door alarm MCU 72, or both may continue to monitor the door 18 at 780 to determine when the door 18 is closed. In response to detecting that the door 18 is closed, the main MCU 40, the door alarm MCU 72, or both may reset the alarm at 790. For example, the main MCU 40 may detect that the door 18 has closed via the open door sensor 58 for the door 18 and instruct the door alarm MCU 72 to proceed to 770 in order to cease monitoring the angle of the door 18 and enter a sleep state. In other embodiments, the door alarm MCU 72 may determine that the door 18 is closed in response to the detected angle $\alpha_2$ having a predetermined relationship (e.g., less than or equal to) a predetermined value such as 0°.

Various embodiments have been described herein by way of example and not by way of limitation in the accompanying figures. For clarity of illustration, exemplary elements illustrated in the figures may not necessarily be drawn to scale. In this regard, for example, the dimensions of some of the elements may be exaggerated relative to other elements to provide clarity. Furthermore, where considered appropriate, reference labels have been repeated among the figures to indicate corresponding or analogous elements.

Moreover, certain embodiments may be implemented as a plurality of instructions on a tangible, computer readable storage medium such as, for example, flash memory devices, hard disk devices, compact disc media, DVD media, EEPROMs, etc. Such instructions, when executed by one or more computing devices, may result in the one or more computing devices such as the MCUs 40, 72 performing various aspects of the processes depicted in FIGS. 6 and 7.

While the present disclosure has described certain embodiments, it will be understood by those skilled in the art that various changes may be made and equivalents may be substituted without departing from the intended scope of protection. In addition, many modifications may be made to adapt a particular situation or material to the teachings of the present disclosure without departing from its scope. Therefore, it is intended that the present disclosure not be limited to the particular embodiment or embodiments disclosed, but encompass all embodiments falling within the scope of the appended claims.

What is claimed is:

1. A method, comprising:

detecting that a door of a refrigeration device is moving from an open state toward a closed state;

detecting a failed attempt at closing the door in response to ceased movement of the door before the door reaches the closed state; and in response to detecting the failed attempt, generating a notification indicative of the detected failed attempt at closing the door.

2. The method of claim 1, further comprising:

detecting an angle of the door of the refrigeration device with respect to a refrigerated compartment of the refrigeration device; and detecting that the door is moving from the open state toward the closed state based on the detected angle of the door.

3. The method of claim 1, further comprising:

detecting an angle of the door of the refrigeration device with respect to a refrigerated compartment of the refrigeration device; and determining an attempt at closing the door has commenced after detecting the angle of the door has a predetermined relationship to a predetermined threshold angle.

4. The method of claim 1, further comprising:

detecting an angle of the door of the refrigeration device with respect to a refrigerated compartment of the refrigeration device; and determining an attempt at closing the door has failed based on a rate of change of the detected angle.

5. The method of claim 1, further comprising:

detecting a distance between a refrigerated compartment and a surface of the door of the refrigeration device facing the refrigerated compartment; and detecting that the door is moving from the open state toward the closed state based on the detected distance.

6. The method of claim 1, further comprising:

using a distance sensor to detect a distance between a refrigerated compartment and a surface of the door of the refrigeration device facing the refrigerated compartment; and determining an attempt at closing the door has commenced after determining the door is within range of the distance sensor.

7. The method of claim 1, further comprising:

detecting a distance between a refrigerated compartment and a surface of the door of the refrigeration device facing the refrigerated compartment; and determining an attempt at closing the door has failed based on a rate of change of the detected distance.

8. The method of claim 1, wherein said generating the notification comprises sounding an audible alarm.

9. The method of claim 1, wherein said generating the notification comprises sending a notification message via a network interface of the refrigeration device.

10. A refrigeration device, comprising:

a refrigerated compartment;

a door movable between a closed state that seals the refrigerated compartment and an opened state that grants access to the refrigerated compartment;

a sensor configured to provide a signal indicative of a position of the door; and one or more microcontrol units coupled to the sensor, the one or more microcontrol units configured to detect, based on the signal from the sensor, a failed attempt at closing door, and in response to detecting the failed attempt, to generate a notification indicative of the detected failed attempt.

11. The refrigeration device of claim 10, wherein:

the sensor comprises an angle sensor configured to detect an angle of the door with respect to the refrigerated compartment;

the sensor is further configured to generate the signal such that the signal is indicative of the detected angle between the door and the refrigerated compartment; and the one or more microcontrol units are further configured to detect that the door is moving from the open state toward the closed state based on the detected angle indicated by the signal.

12. The refrigeration device of claim 10, wherein:

the sensor comprises an angle sensor configured to detect an angle of the door with respect to the refrigerated compartment;

the sensor is further configured to generate the signal such that the signal is indicative of the detected angle between the door and the refrigerated compartment; and the one or more microcontrol units are further configured to determine that an attempt at closing the door has commenced based on the detected angle provided by the signal having a predetermined relationship to a predetermined threshold angle.

13. The refrigeration device of claim 10, wherein:

the sensor comprises an angle sensor configured to detect an angle of the door with respect to the refrigerated compartment;

the sensor is further configured to generate the signal such that the signal is indicative of the detected angle between the door and the refrigerated compartment; and the one or more microcontrol units are further configured to determine that an attempt at closing the door has failed based on a rate of change of the detected angle provided by the signal.

14. The refrigeration device of claim 10, wherein:

the sensor comprises a distance sensor configured to detect a distance between the refrigerated compartment and a surface of the door facing the refrigerated compartment;

the sensor is further configured to generate the signal such that the signal is indicative of the detected distance between the refrigerated compartment and the surface of the door; and the one or more microcontrol units are further configured to detect that the door is moving from the open state toward the closed state based on the detected distance provided by the signal.

15. The refrigeration device of claim 10, wherein:

the sensor comprises a distance sensor configured to detect a distance between the refrigerated compartment and a surface of the door facing the refrigerated compartment;

the sensor is further configured to generate the signal such that the signal is indicative of the detected distance between the refrigerated compartment and the surface of the door; and the one or more microcontrol units are further configured to determine an attempt at closing the door has commenced after determining the door is within range of the distance sensor.

16. The refrigeration device of claim 10, wherein:

the sensor comprises a distance sensor configured to detect a distance between the refrigerated compartment and a surface of the door facing the refrigerated compartment;

the sensor is further configured to generate the signal such that the signal is indicative of the detected distance between the refrigerated compartment and the surface of the door; and the one or more microcontrol units are further configured to determine an attempt at closing the door has failed based on a rate of change of the detected distance provided by the signal.

17. The refrigeration device of claim 10, further comprising a speaker coupled to the one or more microcontrol units, wherein the one or more microcontrol units are further configured to generate the notification by driving the speaker to sound an audible alarm.

18. The refrigeration device of claim 10, further comprising a network interface, wherein the one or more microcontrol units are further configured to generate the notification by sending a notification message via the network interface.

19. A computer-readable medium, comprising a plurality of instructions that in response to being executed, cause a refrigeration device to:

detect that a door of the refrigeration device is moving from an open state toward a closed state;

detect a failed attempt at closing the door in response to ceased movement of the door before the door reaches the closed state; and in response to detecting the failed attempt, generate a notification indicative of the detected failed attempt at closing the door.

20. The computer-readable medium of claim 19, wherein the plurality of instructions further cause the refrigeration device to sound an audible alarm in response to detecting the failed attempt.

* * * * *